United States Patent [19]

Bayh, III

[11] Patent Number: 4,655,706

[45] Date of Patent: Apr. 7, 1987

[54] BURNER

[75] Inventor: Russell I. Bayh, III, Carrollton, Tex.

[73] Assignee: Otis Engineering Corporation, Carrollton, Tex.

[21] Appl. No.: 775,824

[22] Filed: Sep. 13, 1985

Related U.S. Application Data

[60] Continuation of Ser. No. 606,618, May 3, 1984, abandoned, which is a division of Ser. No. 424,172, Sep. 27, 1982, abandoned.

[51] Int. Cl.[4] ..... F23C 7/00

[52] U.S. Cl. ..... 431/187; 431/12; 431/284; 239/419.3; 239/427.3; 239/427.5; 239/397

[58] Field of Search ..... 431/10, 12, 175, 187, 431/189, 284, 354, 202, 186; 239/419.3, 427.3, 427.5, 397, 390

[56] References Cited

U.S. PATENT DOCUMENTS

| | | | |
|---|---|---|---|
| 1,339,579 | 5/1920 | Runyan et al. . | |
| 1,740,296 | 12/1929 | Gerdes et al. . | |
| 1,956,506 | 4/1934 | Johnson | 239/419.3 |
| 2,239,025 | 4/1941 | Vigneault | 431/354 |
| 2,319,591 | 5/1943 | Ferguson . | |
| 2,368,373 | 1/1945 | Morrell | 431/187 X |
| 2,391,422 | 12/1945 | Jackson . | |
| 2,546,967 | 4/1951 | Breault | 239/414 |
| 2,655,986 | 10/1953 | Pennington . | |
| 2,834,407 | 5/1958 | Mason | 431/175 X |
| 3,236,280 | 2/1966 | Greinke . | |
| 3,733,165 | 5/1973 | Nakagawa et al. | 431/10 |
| 3,797,992 | 3/1974 | Straitz III | 431/285 |
| 3,852,022 | 12/1974 | Medeot et al. | 431/186 |
| 3,861,857 | 1/1975 | Straitz | 431/202 |
| 3,894,831 | 7/1975 | Glotin et al. | 431/4 |
| 3,914,094 | 10/1975 | Landry | 431/202 |
| 3,995,985 | 12/1976 | Straitz III | 431/284 |
| 4,011,995 | 3/1977 | Krause, Jr. | 239/404 |
| 4,021,186 | 5/1977 | Tenner | 431/10 |
| 4,063,870 | 12/1977 | Deruelle | 431/187 |
| 4,095,929 | 6/1978 | McCartney | 431/19 |
| 4,113,417 | 9/1978 | Deruelle | 431/12 X |
| 4,141,505 | 2/1979 | Reich | 239/431 |
| 4,144,016 | 3/1979 | Takahashi et al. | 431/175 X |
| 4,155,702 | 5/1979 | Miller et al. | 431/353 |
| 4,297,093 | 10/1981 | Morimoto et al. | 431/10 |
| 4,341,512 | 7/1982 | Wojcieson et al. | 431/284 |
| 4,348,168 | 9/1982 | Coulon | 431/9 |
| 4,375,954 | 3/1983 | Trudel | 431/284 X |
| 4,384,677 | 5/1983 | Rotolico | 239/427.3 |
| 4,412,811 | 11/1983 | Pedrosa et al. | 431/202 |
| 4,452,583 | 6/1984 | Brooks | 431/202 |

FOREIGN PATENT DOCUMENTS

| | | |
|---|---|---|
| 1524334 | 5/1968 | France . |
| 2013573 | 4/1970 | France . |
| 2109683 | 5/1972 | France . |

OTHER PUBLICATIONS

PCT International Publication No. WO 83/02147, dated Jun. 23, 1983.

*Primary Examiner*—Randall L. Green
*Attorney, Agent, or Firm*—Vinson & Elkins

[57] ABSTRACT

A burner which can be used to dispose of heavy crude waste oil and petroleum products contaminated with drilling mud. The burner includes a nozzle assembly which internally mixes atomizing fluid with the primary fluid being disposed of by the burner. If desired, secondary fluid can be injected into the nozzle assembly to improve the combustion of primary fluid. In the alternative, secondary fluid can be injected into the compound mixture of atomizing fluid and primary fluid exterior to the nozzle assembly.

7 Claims, 11 Drawing Figures

BURNER

This application is a continuation of my copending application Ser. No. 06,606,618 filed May 3, 1984 which is a division of my copending application Ser. No. 06/424,172, Filed Sept. 27, 1982, entitled "BURNER", both abandoned.

BACKGROUND OF THE INVENTION

1. Field of the Invention

This invention relates to burners for combustion of hydrocarbon fluids and is particularly suitable for use during drilling and/or production testing of oil and gas wells.

2. Description of the Prior Art

U.S. Pat. Nos. 3,797,992 titled Crude Oil Burner; 3,861,857 titled Flammable Liquid Waste Burner; and 3,995,985 titled Crude Oil Burner disclose burners which are designed for use while testing oil and gas well production. U.S. Pat. Nos. 3,995,985 and 3,861,857 further disclose the use of flammable gas to boost the combustion of waste liquids and to produce a "smokeless" burn of heavy crude oil.

Frequently, hydrocarbons from downhole formations will become contaminated by drilling fluids (mud). Burning is one method for disposing of the resulting mixture. Also, many types of crude oil are very difficult to burn as produced at the well surface. U.S. Pat. Nos. 3,914,094 titled Waste Oil Burner; 4,141,505 titled Heavy Fuel Oil Nozzle; and 4,155,702 titled Burner disclose various devices which aid the combustion of hydrocarbon fluids having less than ideal burning characteristics. These patents describe various problems associated with burning heavy crude or waste oil.

U.S. Pat. No. 4,011,995 titled Burner Nozzle Assemble discloses a nozzle assembly which internally mixes compressed gas with flammable fluids. The nozzle assembly uses the same compressed gas to shape and control the compound mixture of gas and flammable fluid after it exits the nozzle assembly.

U.S. Pat. Nos. 3,797,992; 3,861,857; 3,995,985; 3,914,094; 4,011,995; 4,141,505; and 4,155,702 are incorporated by reference for all purposes within this application.

SUMMARY OF THE INVENTION

The present invention discloses a burner for combustion of liquid hydrocarbons comprising a nozzle assembly having a longitudinal passageway therethrough for receiving a primary liquid hydrocarbon from a source exterior to the burner and spraying the primary liquid into an open air flame, chamber means surrounding the longitudinal passageway for receiving atomizing fluid from a source exterior to the burner, means for directing the atomizing fluid from the chamber means to form a conical pattern around the exit end of the longitudinal passageway, a throat means which partially defines the longitudinal passageway, and the length of the throat means selected to extend into the conical pattern formed by the atomizing fluid exiting the chamber means.

One object of the present invention is to provide a burner for the combustion of heavy crude oil, waste oil, and hydro-carbon fluids contaminated with drilling mud.

Another object of the present invention is to reduce the visible smoke produced by combustion of hydrocarbon fluids.

A still further object of the present invention is to provide a burner with means for injecting a flammable fluid into waste oil to improve its combustion by the burner.

Another object of the present invention is to provide a nozzle assembly for a burner which has passageways for triaxial flow of atomizing fluid or air, a primary fluid being disposed of such as crude oil or waste oil, and a secondary, flammable fluid to improve the combustion process.

A still further object of the present invention is to provide a nozzle assembly for crude oil burners which efficiently mixes and atomizes the crude oil by injecting air into the crude oil at a compound angle with respect to the axis of the crude oil flow stream. Injection of the air produces a swirling motion by the resulting compound mixture. The volume of air injected can be adjusted to produce optimum burning of the crude oil.

A further object of the present invention is to provide a burner with means for injecting diesel fuel either into a flow stream of crude oil within the burner's nozzle assembly prior to mixing the crude oil with air or into a compound mixture of crude oil and air external to the nozzle assembly. The method of injecting diesel fuel is selected to produce the optimum combustion of the particular type of crude oil being disposed of by the burner.

An important advantage of the present invention is the swirling motion of the compound mixture of air and oil. This motion prevents liquid boundary layer buildup within the throat of the nozzle assembly and allows better mixing of the oil and air prior to being sprayed from the nozzle assembly into the open air flame. The extended throat of the nozzle assembly allows more time for mixing and enhances the spray angle at which external air meets the existing high velocity compound mixture. The nozzle tip extending from the throat of the nozzle assembly allows external air to better shape and control the oil spray.

Another advantage of mixing air and oil within the nozzle assembly is the reduced effective viscosity of the resulting compound mixture. Reduction in viscosity is directly related to the ability of the burner to atomize the liquid hydrocarbon to improve combustion thereof. High viscosity liquid is associated with large droplets when the liquid is sprayed into open air. All liquid hydrocarbons must be atomized or reduced to very small droplets before they will burn.

Additional objects and advantages will be apparent to those skilled in the art from studying the following written description in conjunction with the drawings and the claims.

DESCRIPTION OF THE PREFERRED EMBODIMENTS

At various times during the drilling, testing, and completion of offshore oil and gas wells, it is necessary to dispose of waste fluids and/or crude petroleum fluids. These fluids are frequently disposed of by burning due to the limited storage capacity on most drill ships or offshore platforms. The cost and difficulty of transporting these fluids to a shore disposal site is generally prohibitive. The term "primary fluid" as sued in this patent application means heavy crude oil, waste oil, hydrocarbon fluids contaminated with drilling mud, and/or formation fluids produced while testing wells.

Figure 1A:
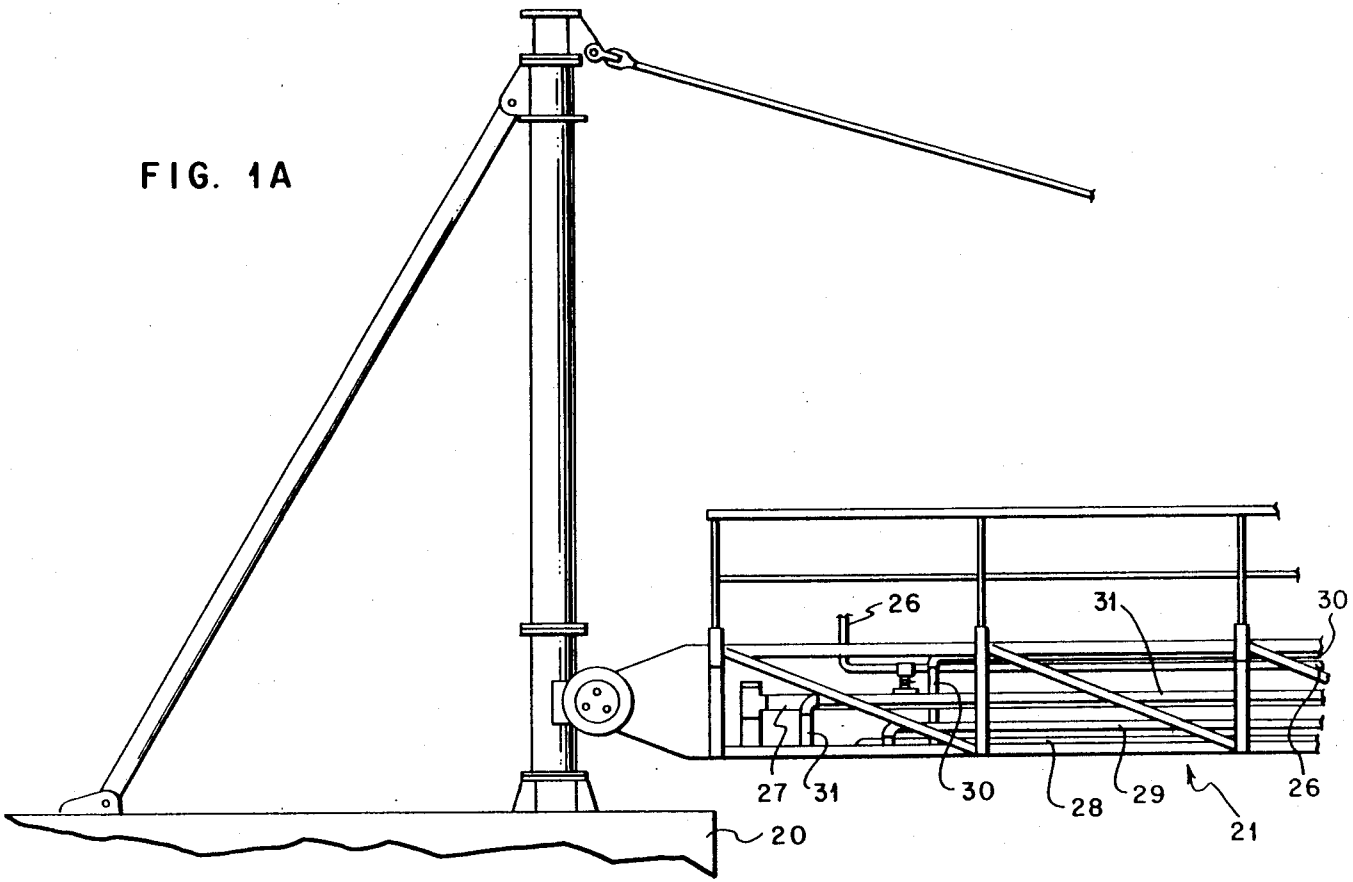
FIGS. 1A and 1B are drawings in elevation with portions broken away showing a burner supported on a boom which is in turn attached to a work platform or vessel. The burner comprises a nozzle assembly incorporating one embodiment of the present invention.
Figure 1B:
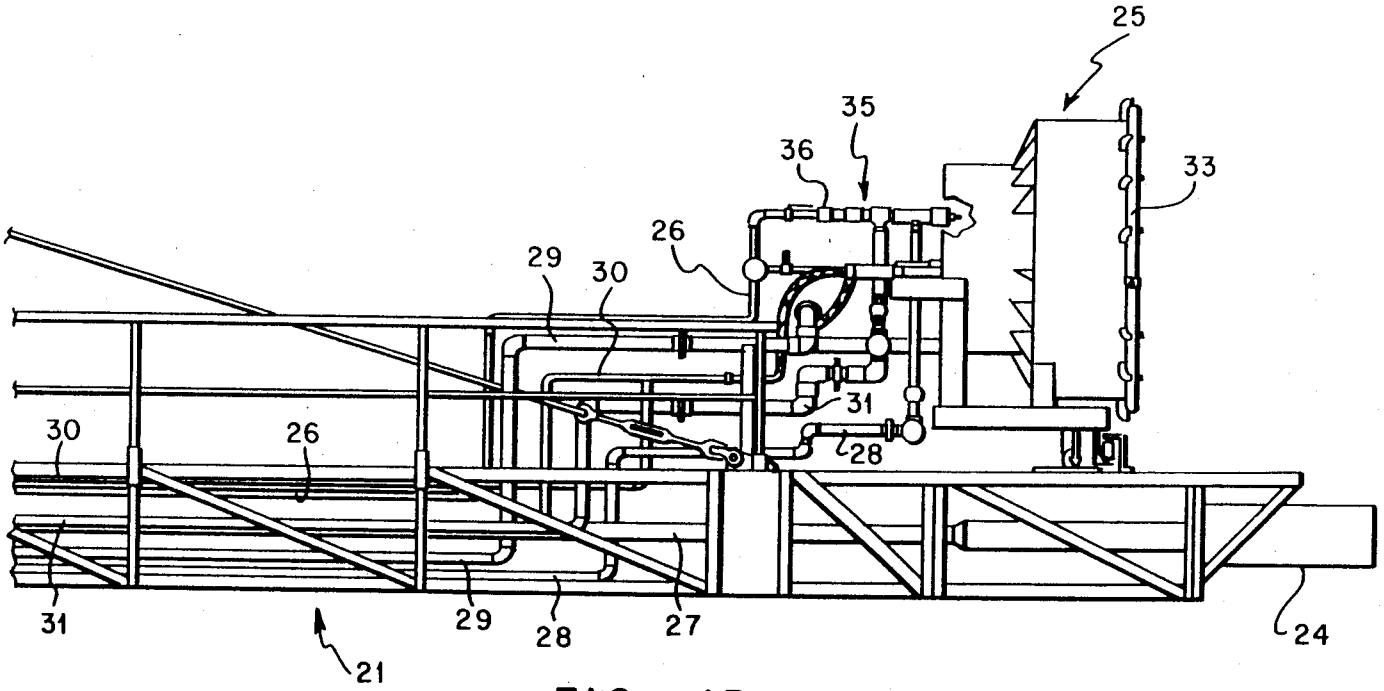
Figure 2A:
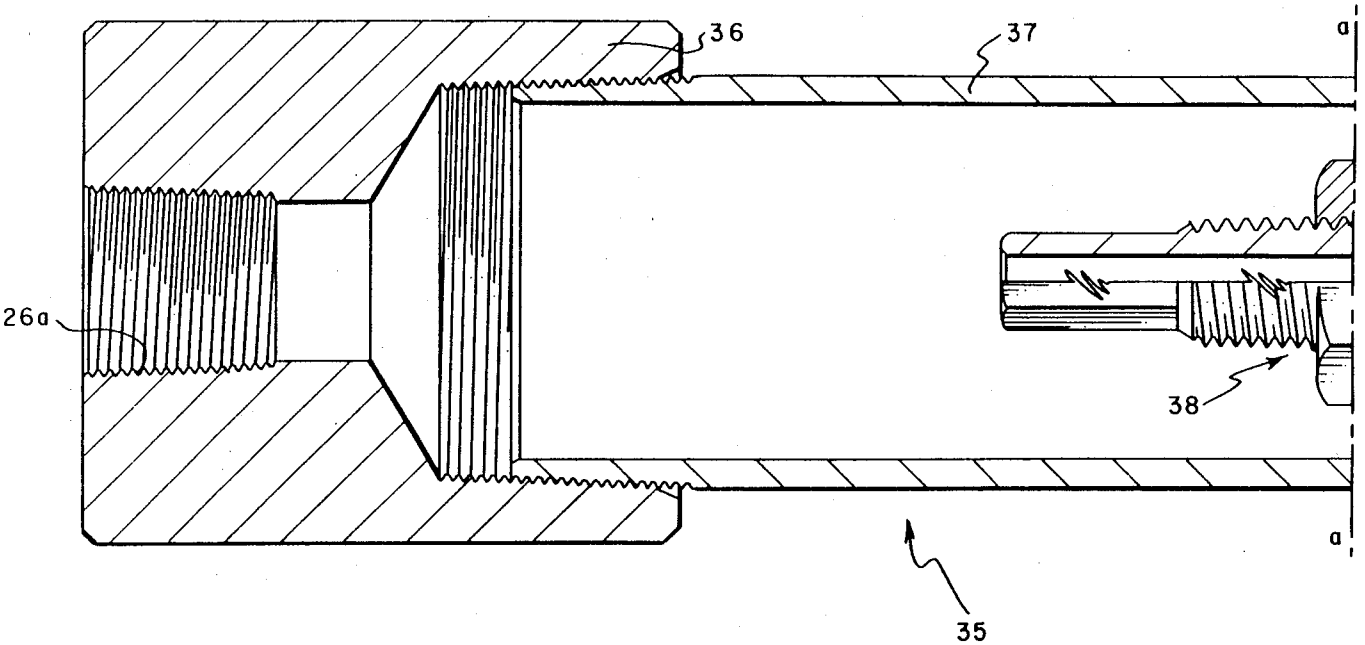
FIGS. 2A, B, C and D are schematic drawings, in longitudinal section with portions broken away, of the nozzle assembly shown in FIGS. 1A and B.
Figure 2B:
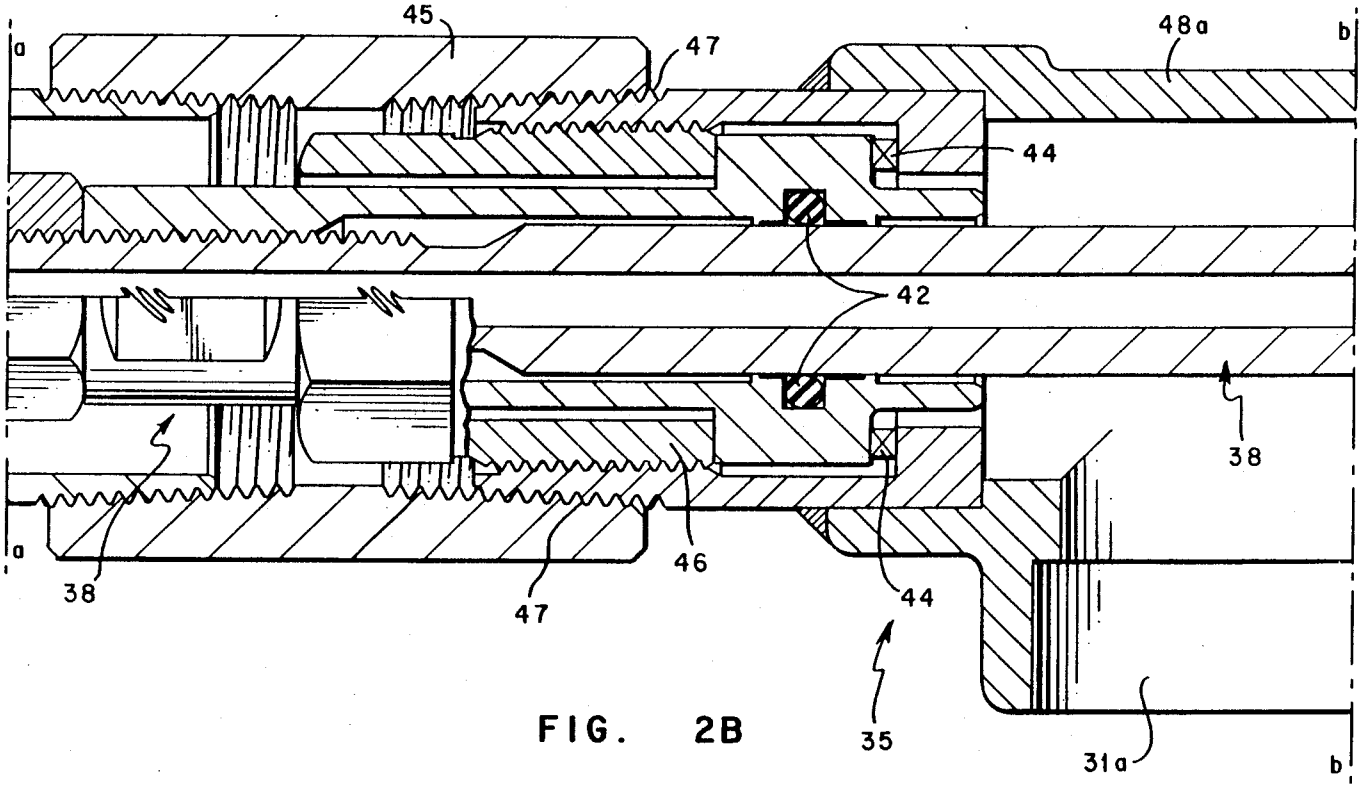
Figure 2C:
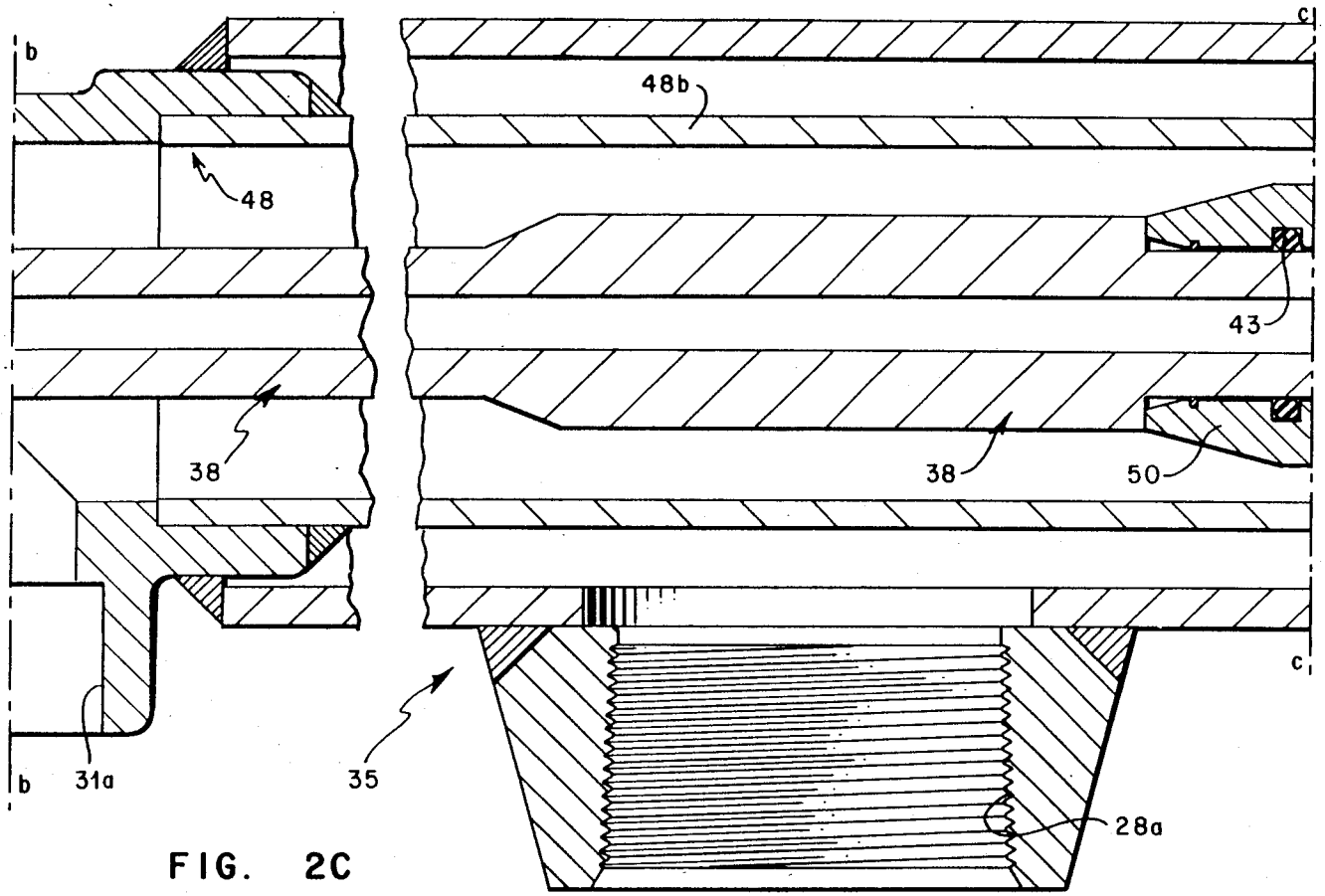
Figure 2D:
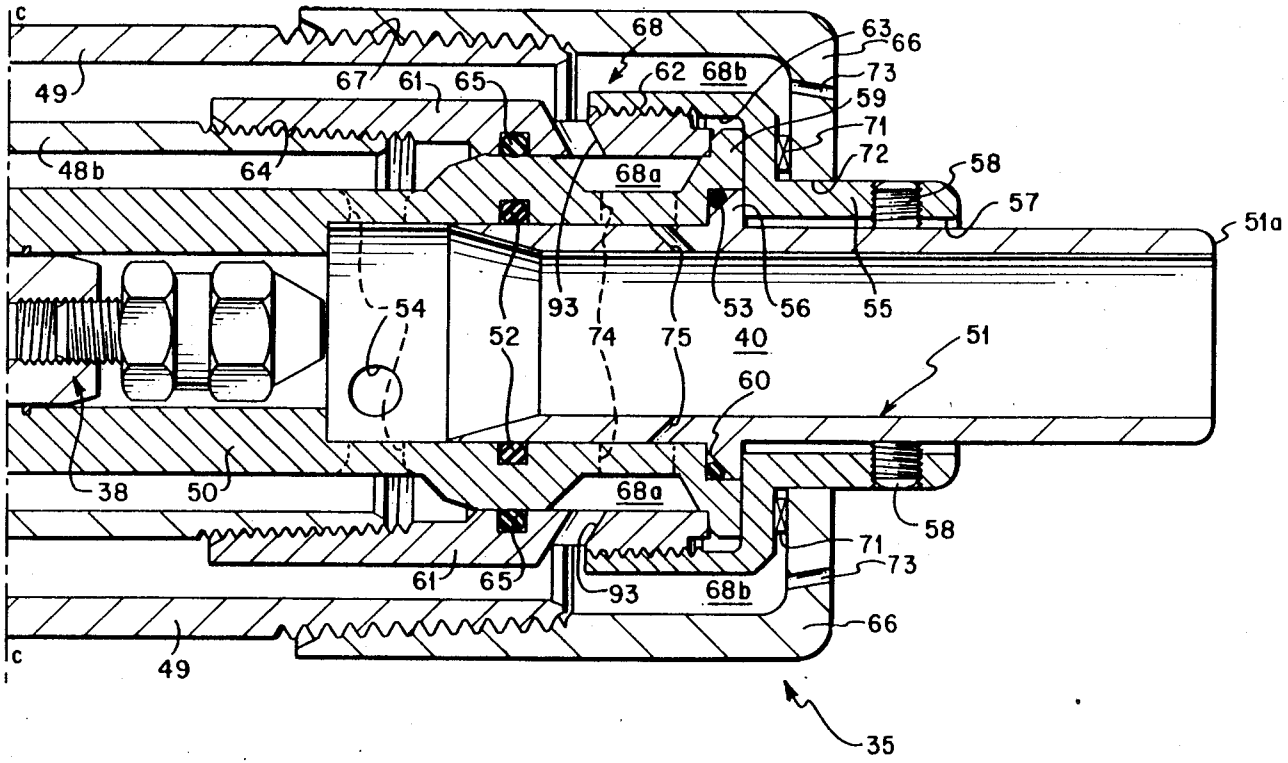

In FIGS. 1A and B a typical work platform 20 such as a drilling vessel, semi-submersible, or jack-up is shown with boom 21 extending therefrom. Burner 25 is secured near the extreme end of boom 21 opposite from platform 20. Typically, boom 21 can be pivoted and/or elevated as appropriate for the wind weather conditions.

Gas flare 24 extends from the extreme end of boom 21 below burner 25. Flare 24 is used to dispose of any gas produced during well testing. Fluid supply lines 26 through 31 which extend from platform 20 to burner 25 are supported by boom 21. The purpose for each of these fluid supply lines will be explained later.

One method for minimizing visible smoke is to spray water on the flame (not shown) produced by burner 25. Supply line 29 through appropriate connections provides water to water spray ring 33 on the extreme end of burner 25. As explained in U.S. Pat. No. 3,797,992, water sprayed from ring 33 facilitates smokeless combustion.

Burner 25 preferably has three nozzle assemblies 35. The actual number of nozzle assemblies 35 can be varied as required for the volume of fluid disposed of by burner 25. FIGS. 2A–2D show nozzle assembly 35 in detail. Nozzle assembly 35 includes three concentric flow paths to deliver primary fluid, secondary fluid and an atomizing fluid to longitudinal passageway 40 which extends therethrough.

Sometimes, petroleum fluids produced directly from a well are difficult to burn. This is particularly true for high viscosity, heavy crude oil and crude oil contaminated by drilling mud, salt water, etc. To aid in combustion of these primary hydrocarbon fluids, the present invention provides means for injecting a secondary, more highly combustible fluid into the primary fluid being disposed of by burner 25. Diesel fuel is one liquid which can be satisfactorily used as the secondary fluid. Natural gas, methane, kerosene, and other similar petroleum products could be used as the secondary fluid. Diesel fuel is supplied to nozzle assembly 35 via secondary fluid supply line 26 and appropriate connections including threaded opening **26*a* in connector 36**.

Secondary fluid is received within hollow cylinder 37. Flow tube means 38 extends from within hollow cylinder 37 to longitudinal passageway 40 to communicate secondary fluid therewith. Appropriately sized O-rings 42 and 43 and packing means 44 are provided to prevent undesired communication between the secondary fluid and other fluids within nozzle assembly 35.

A unique feature of the present invention is that hollow cylinder 37 can be removed from nozzle assembly 35 by disengaging threaded coupling 45. Flow tube means 38 can be removed from longitudinal passageway 40 by disengaging locking cylinder 46 after removing cylinder 37. This feature allows for ease of maintenance of nozzle assembly 35. Also, a properly sized cap or end closure (not shown) can be attached to threads 47 to allow operation of nozzle assembly 35 with flow tube means 38 removed. As will be demonstrated later, the end of longitudinal passageway 40 which receives flow tube means 38 can be sealed by plug means 70. See FIG. 3B.

Primary fluid is supplied to nozzle assembly 35 via supply line 31 and appropriate connections including opening **31*a*. The primary fluid is received within cylindrical housing 48 which is formed from two subassemblies 48*a* and 48*b* for ease of manufacture and assembly. Flow tube means 38 is concentrically positioned within cylindrical housing 48**.

Atomizing fluid is supplied to nozzle assembly 35 by atomizing fluid supply line 28 and appropriate connections including opening **28*a*. Compressed air is preferably used as the atomizing fluid in nozzle assembly 35. As will be explained later in more detail, atomizing fluid (air) mixes with the primary fluid in longitudinal passageway 40 to facilitate combustion. Also, the same atomizing fluid is used to shape and control the spray of the compound mixture (air, primary fluid and secondary fluid) which exists from longitudinal passageway 40**.

Atomizing fluid is received within cylindrical housing 49 from opening **28*a*. Housing 49 is concentrically aligned with and surrounds housing 48. Housing 49 is a portion of the chamber means which surrounds longitudinal passageway 40** and supplies atomizing fluid thereto.

Longitudinal passageway 40 is defined by two subassemblies, nozzle body or receiver 50 and throat means 51. Flow tube means 38 is secured within one end of receiver 50. A portion of throat means 51 is secured within the other end of receiver 50. The remainder of throat means 51 extends longitudinally from receiver 50. O-rings 52 and 53 are positioned on the exterior of throat means 51 to prevent undesired fluid communication between longitudinal passageway 40 and the exterior of throat means 51.

A plurality of openings 54 extends radially through receiver 50 to allow primary fluid from cylindrical housing 48 to communicate with longitudinal passageway 40. Openings 54 are positioned intermediate the ends of receiver 50. Preferably, openings 54 are located between the end of flow tube means 38 and the beginning of throat means 51. This configuration allows for more complete mixing of primary and secondary fluids before the resulting mixture exits from throat means 51.

Retaining swage 55 is used to secure receiver 50 and throat means 51 to each other. Swage 55 is basically a hollow cylinder with a reduced inside diameter portion 57 and an enlarged inside diameter portion 63. Flange 56 is provided on the exterior of throat means 51 intermediate the ends thereof. Receiver 50 abuts one side of flange 56, and retaining swage 55 abuts the other. Inside diameter portion 57 of swage 55 is slightly larger than the adjacent outside diameter of throat means 51. A plurality of set screws 58 extends through portion 57 of swage 58 to contact throat means 51 and prevent rotation of throat means 51 relative to swage 55 and receiver 50.

End 59 of receiver 50 has recess 60 to receive O-ring 53 and flange 56 therein. End 59 has a larger diameter than the other portions of receiver 50. Adapter sub 61 can be engaged by threads 62 to the enlarged inside diameter portion 63 of swage 55. Adapter sub 61 is a hollow sleeve which can slide over the exterior of receiver 50 except for end 59. Thus, the threaded engagement between adapter sub 61 and swage 55 holds end 59 in contact with flange 56 and O-ring 53 trapped therebetween. Cylindrical housing subassembly **48*b* is engaged by threads 64 to adapter sub 61. O-ring 65, carried between adapter sub 61 and receiver 50, prevents undesired communication between the primary fluid in cylindrical housing 48 and the atomizing fluid in cylindrical housing 49**.

End cap 66 is slidably positioned over a portion of swage 55 and engaged by threads 67 to cylindrical housing 49. Swage 55 can slide through circular opening 72 of end cap 66. The inside diameter of end cap 66 is larger than the outside diameter of swage 55 which creates a portion of chamber means 68. Packing means 71 prevents undesired escape of atomizing fluid from chamber means 68. A plurality of ports 73 extends from chamber means 68 through end cap 66. Ports 73 are formed in a circular pattern spaced radially from opening 72. Longitudinal passageway 40, throat means 51, inside diameter portion 57 of swage 55 and opening 72 of end cap 66 are concentrically aligned on the same longitudinal axis. The centerline of each port 73 is tapered inwardly to form an acute angle with respect to the centerline of longitudinal passageway 40. The imaginary point at which the centerline from each port 73 intersects is selected to be longitudinally spaced from the end **51*a* of throat means 51 which extends from swage 55. Atomizing fluid within chamber means 68 can exit through ports 73 to form a conical pattern around end 51*a*. The length of throat means 51 is selected to ensure that burner tip or end 51*a* extends into the conical pattern formed by atomizing fluid exiting ports 73. Thus, ports 73 form a portion of the means for directing the atomizing fluid from chamber means 68 to form a conical pattern around the exit end of longitudinal passageway 40**.

As previously noted, chamber means 68 surrounds longitudinal passageway 40 and receives atomizing fluid from a source exterior to burner 25. Chamber means 68 has two separate portions **68*a* and 68*b* for ease of manufacture and assembly. Ports 73 extend into portion 68*b*. A plurality of apertures 93 extends through adapter sub 61 to communicate atomizing fluid between portions 68*a* and 68*b* of chamber means 68. Receiver 50 also has a plurality of openings 74 which extend radially through its exterior between O-rings 52 and 53. Throat means 51 also has a plurality of internal injection orifices 75 adjacent to openings 74 in receiver 50. Internal injection orifices 75 and openings 74 cooperate to provide openings between chamber means 68 and longitudinal passageway 40 which allow mixing of atomizing fluid and primary fluid prior to exiting from throat means 51**.

Figure 5:
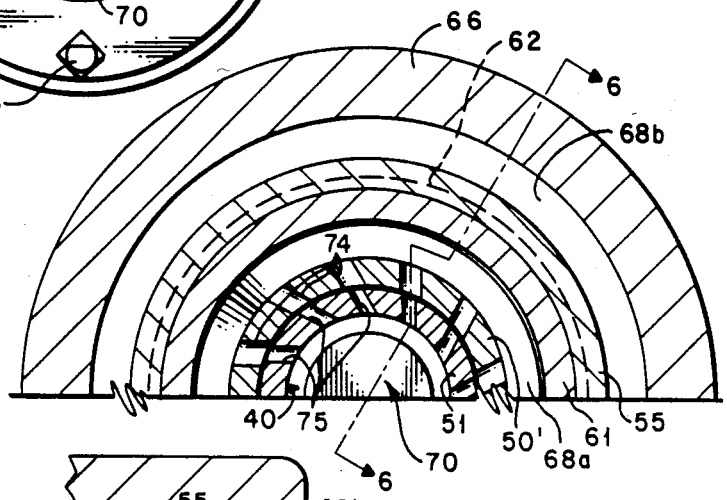
FIG. 5 is a drawing in radial section taken along line 5—5 of FIG. 3B.
Figure 6:
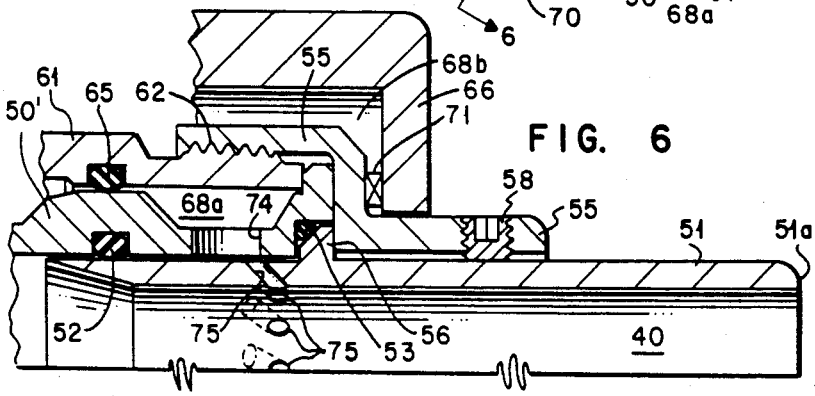
FIG. 6 is a drawing in a longitudinal section taken along line 6—6 of FIG. 5.

As previously noted, set screws 58 prevent rotation of throat means 51 relative to swage 55 and receiver 50. To vary the amount of atomizing fluid entering longitudinal passageway 40 from chamber means 68, set screws 58 are loosened and throat means 51 rotated to increase or decrease the radial alignment between holes 74 and internal injection orifices 75 as desired. The centerline of each internal injection orifice 75 forms a compound angle with respect to the longitudinal axis of throat means 51. This compound angle is best shown in FIGS. 5 and 6. Thus, atomizing fluid entering longitudinal passageway 40 imparts a violent swirling motion to the liquid flowing therethrough. This swirling motion prevents liquid boundary layer buildup within throat means 51 and promotes better mixing of atomizing fluid and primary fluid. The compound angle of orifices 75 significantly improves the ability of burner 25 to dispose of waste oil, heavy crude and/or contaminated petroleum products.

Operating Sequence

Burner 25 and boom 21 are mounted on platform 20 and supply lines 26 through 31 connected therebetween. The primary fluid being disposed of is pumped through supply line 31 and connection **31*a* into cylindrical housing 48. Primary fluid flows from housing 48 through openings 54 into longitudinal passageway 40. A secondary fluid such as diesel fuel can be injected into longitudinal passageway 40 via supply line 26 and flow tube means 38. The secondary fluid mixes with the primary fluid within throat means 51** to improve the combustion of the primary fluid.

Atomizing fluid is also injected into longitudinal passageway 40 via supply line 28, connection **28*a*, cylindrical housing 49, chamber means 68, openings 74 and internal injection orifices 75. The atomizing fluid due to its injection angle causes violent swirling and mixing of the primary and secondary fluids. Air is preferably used as the atomizing fluid. The resulting compound mixture of air, primary fluid and secondary fluid exits throat means 51** at greatly increased velocity due to the expansion of the air. Also, violent mixing of air with the primary fluid reduces its effective viscosity and improves its combustion characteristics.

Atomizing fluid is also focused on the compound mixture exiting throat means 51 by ports 73. This use of atomizing fluid external to throat means 51 controls the shape of the compound mixture and the resulting flame after the compound mixture is ignited. Atomizing fluid from ports 73 also supplies additional oxygen to facilitate more complete combustion (less smoke) of the primary fluid. An electrical ignitor (not shown) and gas supplied through supply line 30 are used to ignite the compound mixture exiting from throat means 51.

If the combustion process is not satisfactory, burner 25 can be secured. Set screws 58 can be loosened to allow rotation of throat means 51 relative to receiver 50. Rotating throat means 51 varies the radial alignment between internal injection orifices 75 and opening 74 to vary the amount of atomizing fluid injected into longitudinal passageway 40. Thus, the present invention allows nozzle assembly 35 to be easily adjusted for optimum combustion of the particular type of primary fluid being disposed of by burner 35.

If secondary fluid is not required, the present invention allows the removal of flow tube means 38 from longitudinal passageway 40. Plug means 70 can be inserted into receiver 50. A blank end cap (not shown) can be attached to threads 47 and nozzle assembly 35 operated with only primary fluid and atomizing fluid flowing therethrough.

Alternative Embodiment

An alternative embodiment of the present invention is shown in FIGS. 3A, 3B, 4, 5, and 6. Like parts as compared to nozzle assembly 35 have the same numerical designation. Parts which function in the same manner but have a slightly modified design as compared to nozzle assembly 35 have the same numerical designation followed by a "'". For example, supply line 26' supplies secondary fluid to nozzle assembly 80 the same as supply line 26 supplies secondary fluid to nozzle assembly 35. The configuration of supply line 26' is slightly modified to accommodate nozzle assembly 80.

Figure 3A:
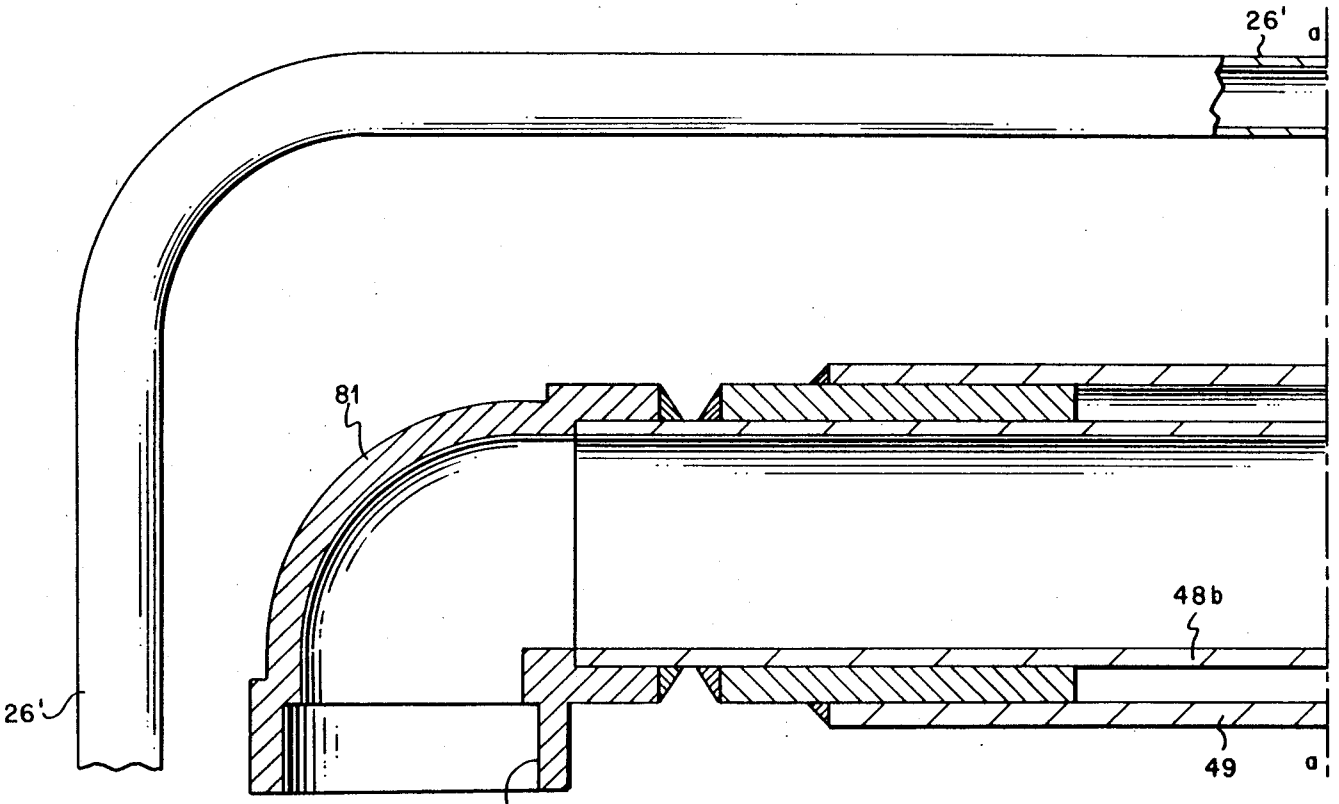
FIGS. 3A and B are schematic drawings, in longitudinal section with portions broken away, showing a nozzle assembly incorporating an alternative embodiment of the present invention.
Figure 3B:
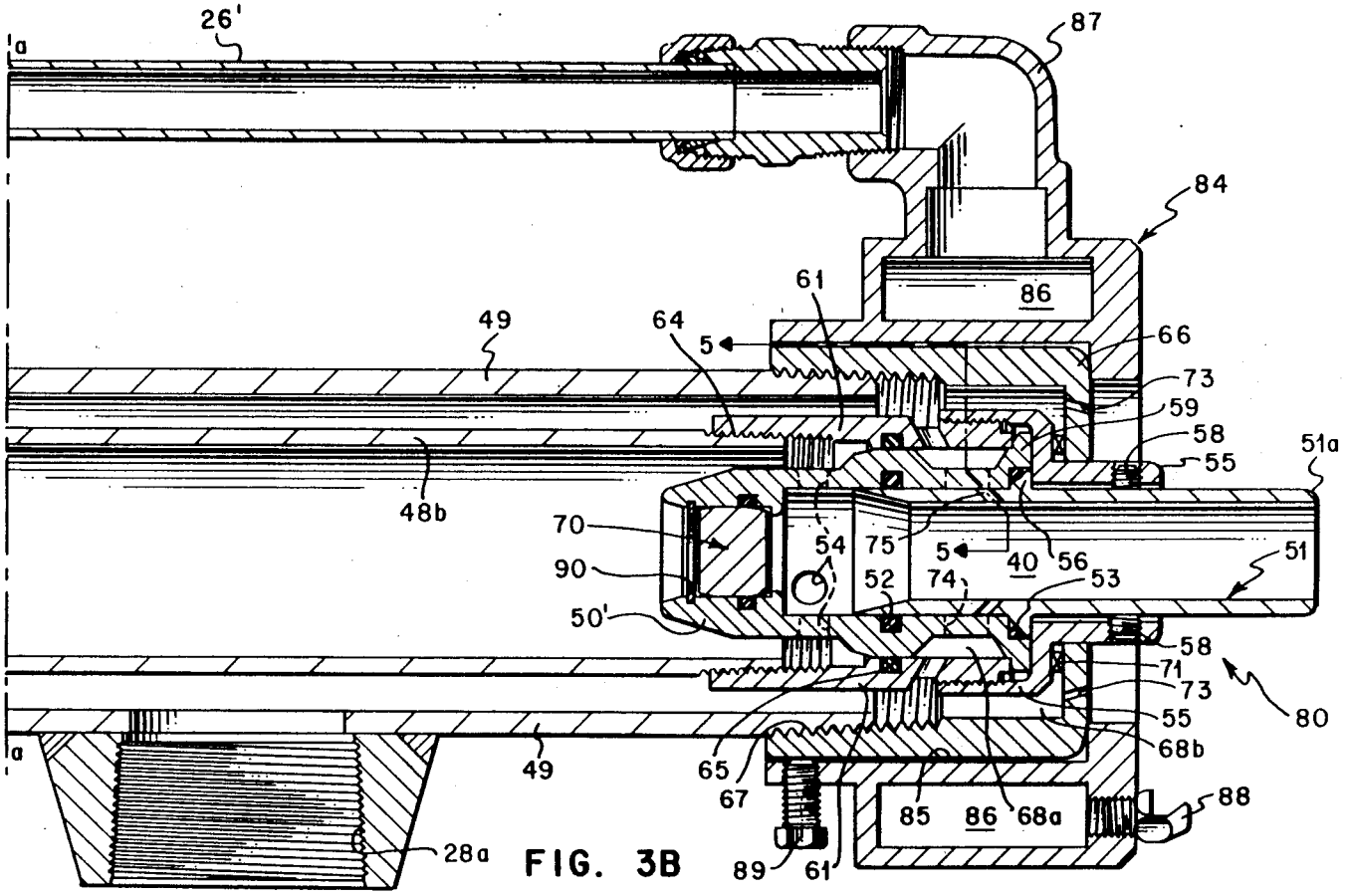
Figure 4:
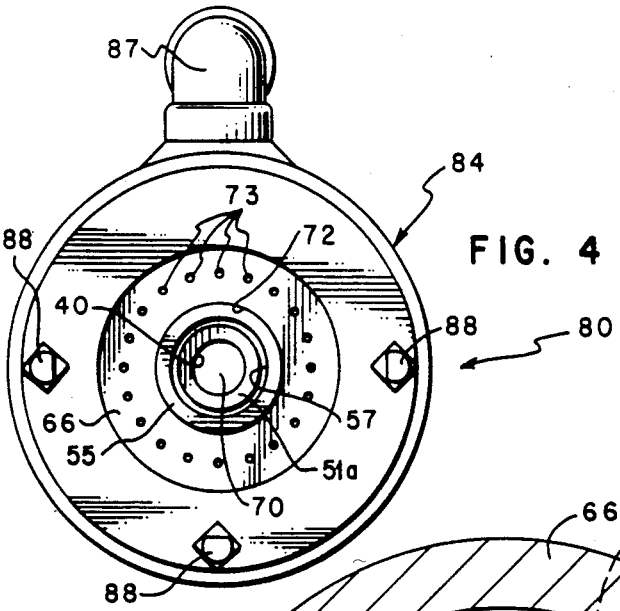
FIG. 4 is a drawing, in elevation and reduced in size, of the front of the nozzle assembly shown in FIG. 3B.

As shown in FIGS. 3A and 3B, flow tube means 38 is not contained within nozzle assembly 80. Plug means 70 is secured by snap ring 90 within receiver 50' to prevent undesired primary fluid flow into longitudinal passageway 40. Primary fluid in supply line 31 is communicated with cylindrical housing **48*b* via elbow 81. If desired, elbow 81 could be replaced by cylindrical housing section 48*a* and flow tube means 38 inserted into receiver 50'. Snap ring 90 can also be used to secure flow tube means 38 within longitudinal flow passageway 40. Openings 54 are provided in receiver 50' to communicate primary fluid into longitudinal passageway 40**.

Atomizing fluid is directed from connection **28*a* into longitudinal passageway 40 via chamber means 68. FIG. 6 demonstrates the compound angle of internal injection orifices 75 with respect to the longitudinal axis of throat means 51. FIG. 5 illustrates how rotation of throat means 51 relative to receiver 50' can vary the radial alignment of openings 74 relative to internal injection orifices 75. The alignment shown in FIG. 5 results in the maximum flow of atomizing fluid into longitudinal passageway 40**.

The major variation between nozzle assembly 35 and nozzle assembly 80 is the installation of secondary fluid container 84 on the exterior of end cap 66. Container 84 is generally cylindrical in shape with opening 85 therein to receive end cap 66. Container 84 has the general shape of a toroid. Annular chamber 86 in container 84 receives secondary fluid from supply line 26' via elbow 87. Flat spray nozzles 88 are mounted on the exterior of container 84. Spray nozzles 88 receive secondary fluid from chamber 86 and spray it radially inward towards the compound mixture exiting throat means 51. Thus, chamber 86 and spray nozzles 88 form a portion of the means for injecting secondary fluid into the compound mixture of atomizing fluid and primary fluid after the compound mixture exits from throat means 51. Set screw 89 is used to releasably secure container 84 to the exterior of end cap 66.

Burner 25 can be assembled with a plurality of either nozzle assemblies 35 or 80 or a combination of each type if desired. Persons skilled in the art will readily see alternative configurations and modifications of the present invention without departing from the scope of the invention which is defined in the following claims.

What is claimed is:

1. A burner for combustion of liquid hydrocarbons comprising:

a. nozzle assembly means having a longitudinal passageway therethrough for receiving a primary fluid from a source exterior to the burner and spraying the primary fluid from the longitudinal passageway such that combustion occurs outside the passageway;

b. a throat means which partially defines the longitudinal passageway;

c. chamber means surrounding the longitudinal passageway for receiving atomizing fluid from a source exterior to the burner;

d. circumferentially arranged port means spaced radially outward from said throat means for directing the atomizing fluid from the chamber means;

e. said port means having their centerlines tapered inwardly and intersecting at a point longitudinally spaced from the outlet end of said throat means to provide a converging spray;

f. said spray diverging as it leaves each port means to form a conical pattern which if not interrupted would intersect the center line of said throat means on both sides of said point;

g. openings between the chamber means and the longitudinal passageway which allows mixing of the atomizing fluid and the primary fluid prior to exiting from the throat means; and h. the length of the throat means selected to extend into and contact a portion of the spray in the conical pattern formed by the atomizing fluid exiting the chamber means permitting the remainder of the spray to converge on the mixture which exits from the throat means.

2. A burner as defined in claim 1, further comprising means for injecting a secondary fluid into the longitudinal passageway to allow mixing between the primary fluid and secondary fluid prior to exiting the throat means.

3. A burner as defined in claim 1, further comprising means for injecting a secondary fluid into the compound mixture of atomizing fluid and the primary fluid after the mixture exits from the throat means.

4. A burner as defined in claim 1, further comprising:

a. said openings comprising a plurality of internal injection orifices formed in the throat means adjacent to a plurality of openings in the chamber means; and b. means for varying the radial alignment between the injection orifices and the openings in said chamber means.

5. A burner as defined in claim 4, further comprising:

a. a hollow cylindrical sleeve comprising the throat means;

b. a flange formed on the exterior of the sleeve intermediate the ends thereof;

c. a receiver surrounding a portion of the sleeve opposite the discharge end of the throat abutting the flange;

d. the longitudinal passageway extending through both the receiver and the throat means; and e. the chamber means surrounding a portion of the hollow sleeve and abutting the flange.

6. A burner as defined in claim 5, wherein the receiver further comprises:

a. a plug means releasably secured within one end of the longitudinal passageway; and b. means for engaging a flow tube means carrying the secondary fluid into the longitudinal passageway after the plug has been removed.

7. A burner as defined in claim 6, wherein the axis of the internal injection orifices forms an acute angle with respect to the longitudinal axis of the throat means.

* * * * *